US009177534B2

(12) United States Patent
Jeganathan et al.

(10) Patent No.: US 9,177,534 B2
(45) Date of Patent: Nov. 3, 2015

(54) DATA TRANSMISSION FOR DISPLAY PARTIAL UPDATE

(71) Applicant: Intel Corporation, Santa Clara, CA (US)

(72) Inventors: Nithyananda S. Jeganathan, Hillsboro, OR (US); Kyungtae Han, Portland, OR (US); Paul S. Diefenbaugh, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 267 days.

(21) Appl. No.: 13/840,159

(22) Filed: Mar. 15, 2013

(65) Prior Publication Data

US 2014/0267336 A1 Sep. 18, 2014

(51) Int. Cl.
*G09G 5/395* (2006.01)

(52) U.S. Cl.
CPC ..... *G09G 5/395* (2013.01); *G09G 2310/04* (2013.01); *G09G 2330/021* (2013.01); *G09G 2360/122* (2013.01)

(58) Field of Classification Search
CPC ..... G09G 2310/04
See application file for complete search history.

(56) References Cited

U.S. PATENT DOCUMENTS

| | | | | |
|---|---|---|---|---|
| 6,452,579 | B1 * | 9/2002 | Itoh et al. | 345/100 |
| 7,616,208 | B2 | 11/2009 | Lauder | |
| 7,649,937 | B2 * | 1/2010 | Rabenold et al. | 375/240.01 |
| 7,777,754 | B2 | 8/2010 | Hochmuth et al. | |
| 8,019,883 | B1 * | 9/2011 | Margulis | 709/231 |
| 2004/0189570 | A1 | 9/2004 | Selwan | |
| 2004/0222995 | A1 * | 11/2004 | Colle | 345/545 |
| 2005/0157949 | A1 | 7/2005 | Aiso et al. | |
| 2006/0061581 | A1 | 3/2006 | Willis et al. | |
| 2007/0200839 | A1 | 8/2007 | Sampsell | |
| 2008/0001934 | A1 | 1/2008 | Wyatt | |
| 2008/0174606 | A1 | 7/2008 | Rengarajan et al. | |
| 2008/0238928 | A1 | 10/2008 | Poddar et al. | |
| 2009/0204957 | A1 | 8/2009 | Nishibayashi et al. | |

(Continued)

FOREIGN PATENT DOCUMENTS

| | | |
|---|---|---|
| JP | 2000-173152 | 6/2000 |
| JP | 2003-122335 | 4/2003 |

(Continued)

OTHER PUBLICATIONS

First Office Action dated Aug. 19, 2014 (+ English translation), in Chinese Patent Application No. 201180002797.3, 32 pages.

(Continued)

*Primary Examiner* — Kee M Tung
*Assistant Examiner* — Ryan D McCulley
(74) *Attorney, Agent, or Firm* — Blakely, Sokoloff, Taylor & Zafman LLP

(57) ABSTRACT

Data transmission for display partial update. An embodiment of an apparatus includes a display controller to transfer pixel data from a frame buffer to a video display and to select a granularity of a plurality of granularities for units of data for the transfer of the pixel data, and a detection element to track updates to the frame buffer, the detection element to identify at least a first damage area of the pixel data that has been changed from a previous image, wherein the display controller is to provide the video display with the identified first damage area of the pixel data in more or more units of data of the chosen granularity.

21 Claims, 9 Drawing Sheets

(56) References Cited

U.S. PATENT DOCUMENTS

| | | | | |
|---|---|---|---|---|
| 2010/0321402 | A1* | 12/2010 | Han et al. | 345/619 |
| 2011/0311149 | A1 | 12/2011 | Yokoyama | |
| 2012/0254645 | A1 | 10/2012 | Jeganathan et al. | |

FOREIGN PATENT DOCUMENTS

| | | |
|---|---|---|
| JP | 2005-033763 | 2/2005 |
| JP | 2006-072351 | 3/2006 |
| JP | 2006-072991 | 3/2006 |
| JP | 2009-098281 | 5/2009 |
| WO | WO-00/65428 | 11/2000 |

OTHER PUBLICATIONS

Notice of Preliminary Rejection dated Oct. 28, 2014 (+ English translation), in Korean Patent Application No. 2013-7028857, 9 pages.
Notification of Reasons for Refusal dated Oct. 28, 2014 (+ English translation), in Japanese Patent Application No. 2014-502542, 11 pages.
International Search Report and Written Opinion mailed Jun. 11, 2012, in International Application No. PCT/US2011/061727, 9 pages.
"Advanced Configuration and Power Interface Specification", Hewlett-Packard Corporation, Intel Corporation, Microsoft Corporation, Phoenix Technologies Ltd., Toshiba Corporation, Revision 4.0a, (Apr. 5, 2010), 731 pages.
"MIPI Alliance Specification for Display Command Set", Mobile Industry Processor Interface, Version 1.02.00, Copyright 2006-2009 MIPI Alliance, Inc., (Jul. 23, 2009), 128 pages.
"MIPI Alliance Specification for Display Serial Interface", Mobile Industry Processor Interface, Version 1.02.00-2, Copyright 2005-2010 MIPI Alliance, Inc., (Jun. 28, 2010), 96 pages.
"MIPI Alliance Standard for Display Bus Interface", Mobile Industry Processor Interface, Version 2.0, Copyright 2005 MIPI Alliance, Inc., (Nov. 16, 2005), 65 pages.
"MIPI Alliance Standard for Display Pixel Interface (DPI-2)", Mobile Industry Processor Interface, Version 2.00, Copyright 2005-2006 MIPI Alliance, Inc., (Jan. 23, 2006), 34 pages.
Office Action dated Dec. 11, 2013, in U.S. Appl. No. 13/078,845, 4 pages.
Office Action mailed Apr. 8, 2013, in U.S. Appl. No. 13/078,845, 9 pages.
Kwa, Seh , et al., "PCI Express Architecture Power Management", Rev 1.1, Intel Corporation, (Nov. 8, 2002), 15 pages.
International Search Report and Written Opinion of the International Searching Authority dated Jun. 2, 2014, in International Patent Application No. PCT/US2014/019569.
Official Letter dated Apr. 24, 2014, in R.O.C. (Taiwanese) Patent Application No. 100145967, 12 pages.
Extended European Search Report dated Nov. 14, 2014, in European Patent Application No. 11862786.8, 9 pages.
Final Notice of Preliminary Rejection dated Jan. 15, 2015 (+ English translation), in Korean Patent Application No. 2013-7028857, 4 pages.
Notice of Reasons for Rejection mailed Apr. 7, 2015 (+ English translation), in Japanese Patent Application No. 2014-502542, 9 pages.
Second Office Action dated Apr. 21, 2015 (+ English translation), in Chinese Patent Application No. 201180002797.3, 7 pages.

* cited by examiner

DATA TRANSMISSION FOR DISPLAY PARTIAL UPDATE

TECHNICAL FIELD

Embodiments described herein generally relate to the field of electronic devices and, more particularly, to a method and apparatus for data transmission for display partial update.

BACKGROUND

Despite improvements in system design, mobile electronic devices and other systems consume a significant amount of power in operation. For this reason, systems utilize numerous different functions to reduce power consumption by, for example, turning off or reducing operation of system elements.

Among the most significant power-consuming elements of a system or device is the display subsystem, which is utilized to provide video data to a screen device. The power consumption of the display subsystem may be reduced by utilization of selective update of a display screen wherein the selective update provides for transmitting portions of an image that include areas that have changed since transmission of a prior image.

However, portions of an image that are changed may exist in various different shapes and sizes, and the use of selective update of the image may still require transmission of a significant amount of data that have not been modified, and thus a display apparatus or system will continue to consume power that is not required to handle the portion of the screen that has changed.

BRIEF DESCRIPTION OF THE DRAWINGS

Embodiments described here are illustrated by way of example, and not by way of limitation, in the figures of the accompanying drawings in which like reference numerals refer to similar elements.

DETAILED DESCRIPTION

Figure 1:
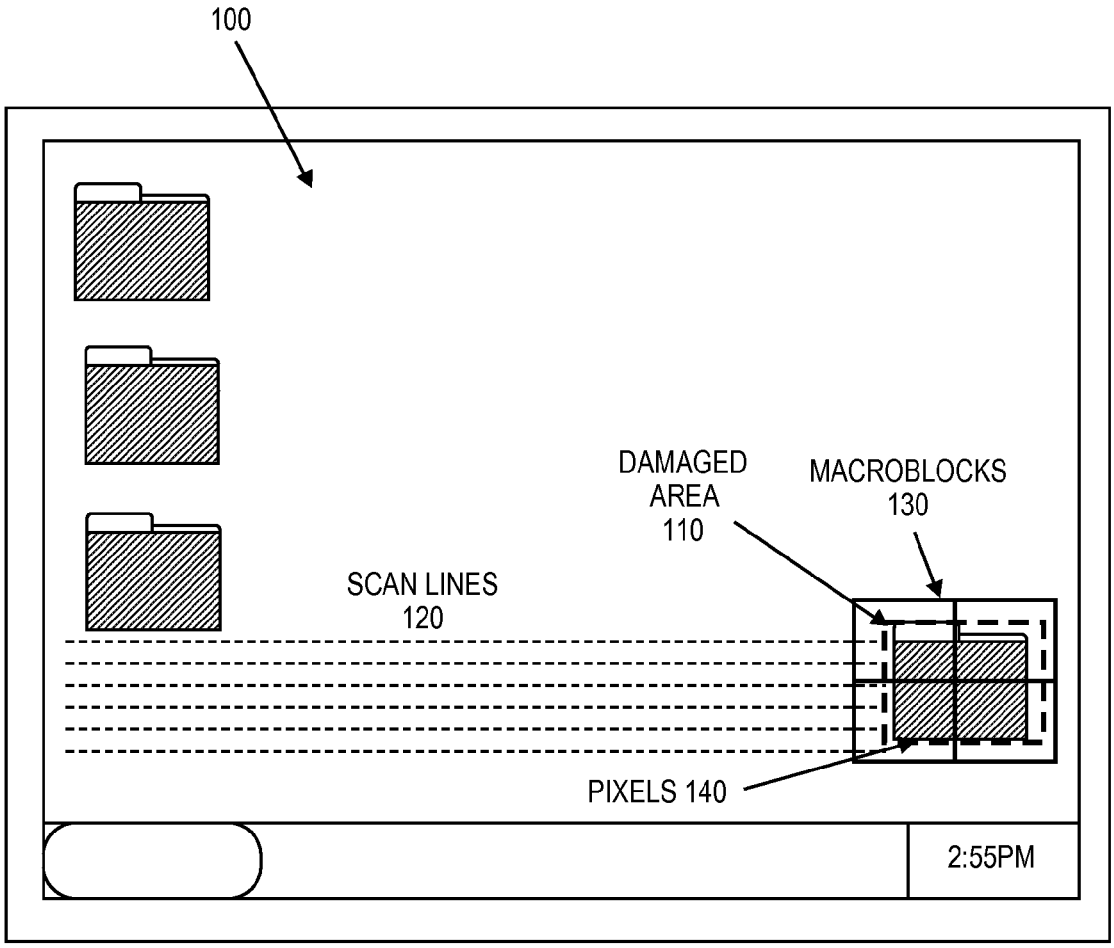
FIG. 1 is an illustration of granularities that may be utilized in an embodiment of an apparatus or system for display partial update.

Embodiments described herein are generally directed to data transmission for display partial update.

As used herein:

"Mobile device" means a mobile electronic device or system including a cellular phone, smart phone, mobile Internet device (MID), handheld computers, personal digital assistants (PDAs), and other similar devices.

In some embodiments, a method, apparatus, or system provides for selective update of a display screen. In some embodiments, the selective update provides for only transmitting portions of an image that have been changed since transmission of a prior image, where such updates may be presented in units of data of one of a plurality of different granularities or forms. In some embodiments, a choice of a unit of selective update may be based upon which of the plurality of the granularities requires a smaller amount of data for transmission. In some embodiments, the plurality of granularities includes damaged areas being transmitted using tiles (such as macroblocks), scan lines, or pixels.

Use of selective updating of a display image in the control of platform power consumption may include operations described in U.S. Patent Application Publication No. 2012/0254645 ("Control of Platform Power Consumption using Coordination of Platform Power Management and Display Power Management").

In some embodiments, a method, apparatus, or system includes coordination between platform power management and display power management to control power consumption of a computing platform. A computing platform includes any platform providing computing operations, including, but not limited to, a mobile device. In some embodiments, a computing platform operates to recognize display power management operations in order to transition to or remain in a lower power state when display operations are not required.

Conventional display subsystems are among the most power consuming devices on mobile platforms, and a significant amount of power is expended in maintaining the contents of display. The constant activity to refresh and maintain the display contents has a significant impact on the battery life of mobile devices. In conventional operation, as long as the display is active, the following tasks are performed: (1) Servicing the display synchronizing interrupt (Vblank) for each video frame; and (2) Transmitting the complete frame buffer (FB) contents to the video display, where the frame buffer is the memory location of the platform that stores the color information (pixel data) of the video screen image to be displayed. Such operations consume a significant amount of power in a device, and such operations are followed in a conventional operation regardless of the amount of change that occurs in a video image.

In some embodiments, an apparatus, system, or process provides for a selective update of a video display, in which only portions of an image that are changed (referred to herein as "damage") are updated, the portions of the damage being transmitted using units of one of a plurality of granularities. Selective pixel update (SPU) (or display partial update (DPU)) is a display power management technology that is focused on reducing the power consumption on the displays by only transmitting the contents of the frame buffer (FB) that have changed from the previous frame to the display panel. In some embodiments, an apparatus, system, or process may utilize selective updates of a display utilizing units of one of the plurality of granularities to reduce the active time for the display, and thus may yield a significant power savings for a computing platform. In some embodiments, a choice of the granularities may be based at least in part on which of the granularities requires the least amount of data to transmit, and thus the least amount of power consumed for the data transmission.

In some embodiments, an apparatus or system operates to select a granularity for transmission of screen contents to the display for SPU technology. In some embodiments, an apparatus or system further operates to optimize the screen update for simpler memory operations in order to increase the performance of the display sub-system.

Figure 7:
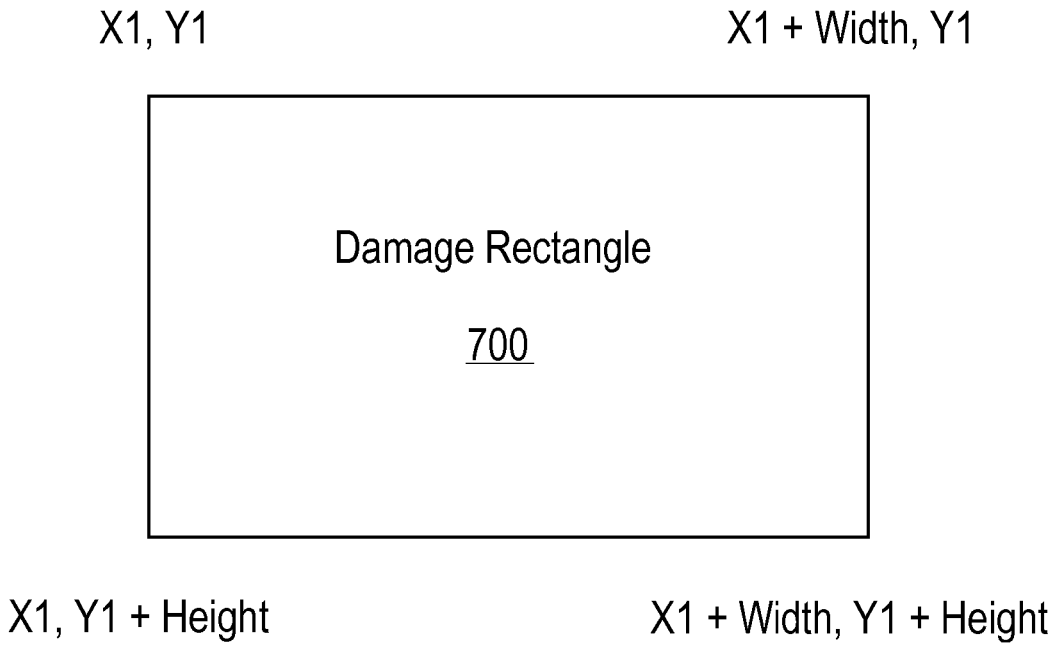
FIG. 7 is an illustration of a screen damage rectangle used in an embodiment of display partial update.

FIG. 1 is an illustration of granularities that may be utilized in an embodiment of an apparatus or system for display partial update. In FIG. 1, a screen image 100 may include a certain damaged area 110, the damaged area 110 representing a portion of the image 100 that has changed. In some embodiments, a partial update from a frame buffer may be provided to a display representing the screen damage 110, where the partial update is transmitted using units of one of a plurality of granularities of data. In some embodiments, the granularities of transmission of data from the frame buffer include scanlines 120 (where a scanline is a line of an image), tiles (or macroblocks) 130 (where a tile represents a rectangle of the image, and wherein the size of a tile may be hardware dependent), and pixels 140. A tile may be defined as a damage rectangle as illustrated in FIG. 7.

In some embodiments, if a certain area of screen changed, then the modified contents may be transmitted in any of the plurality of granularities, such as shown in FIG. 1. However, embodiments are not limited to the granularities or units of data illustrated in FIG. 1, and the plurality of granularities may include other or additional granularities in the division of a data screen.

Figure 2:
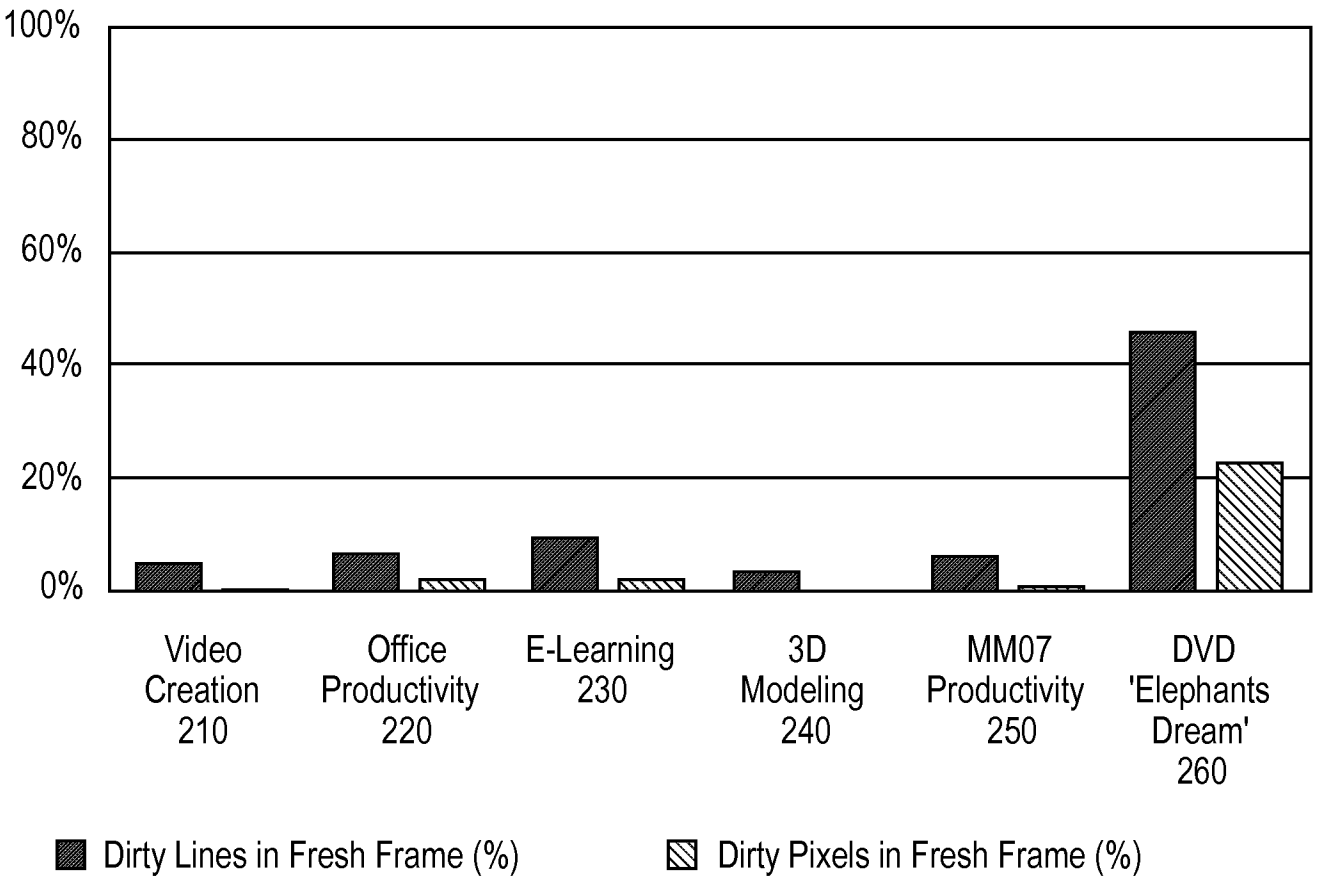
FIG. 2 is an illustration of workload data per modified frame to be transmitted using an embodiment of an apparatus or system for display partial update.

FIG. 2 is an illustration of workload data per modified frame to be transmitted using an embodiment of an apparatus or system for display partial update. In this illustration, an average percentage of dirty lines and dirty pixels for each of a number of different types of images is shown. As shown, video creation 210 may include a small percentage of dirty lines with very few dirty pixels. Similarly, the percentage of dirty pixels is much smaller for office productivity 220, E-learning 230, 3D (three-dimensional) modeling 240, and MM07 (MobileMark 2007) productivity 250. A DVD of a particular video 260 may have a much greater average percentage of dirty lines, but the average percentage of dirty pixels is still much less than the percentage of dirty pixels in a fresh frame.

In a static implementation of SPU, an apparatus or system may, for example, utilize scanline granularity for all partial display updates. This is illustrated in the data values provided FIG. 2, wherein, even though a small block of data is changed in the screen, the entire scanline is sent, thus wasting platform power in transmitting the data to the display.

In some embodiments, a particular granularity of data is dynamically chosen and used for the transmission of data for a damaged area. In contrast with an apparatus of system that utilizes a certain fixed manner of data transmission, such as transmission of scanlines, an embodiment of an apparatus or system makes a choice of a plurality of different granularities, where the choice of a particular granularity is dynamically chosen based at least in part on the size of the updated area. In some embodiments, a technique is provided to dynamically modify the update area depending upon the size of the area using tile based update granularity.

Based on the current trends in display technologies, pixel density of the panels will further increase, and in new panel designs such as Retina display, 4K displays, and others, the number of redundant pixels that will be sent may have significant impact on the platform and display power of the devices. SPU is a display power management mechanism designed to prevent constant screen updates from occurring even when nothing is changing on the screen. This technology has been instrumental in decreasing platform power consumption significantly by reducing the platform activity in semi-active scenarios. Although the power savings using a fixed data transmission format, such as scanline based updates, may be significant, as the display resolution increases the redundant pixel data that will be sent due to a static choice of granularity will increase significantly as well. This in effect will increase the platform power consumption as more pixel data is required to be sent to the display, thus keeping the platform link active for a greater period of time. In some embodiments, in order to reduce the impact of redundant pixel transfer, an apparatus or system utilizes a blended approach that includes dynamically changing granularity based on the particular screen update.

In theory the most optimal mechanism of transmission is the pixels-based granularity as this only sends the pixels that have changed and no other redundant data is sent. However, this process does take into account control data. With every pixel that will be sent, the corresponding x and y coordinate for the location is also transmitted along with the pixel data. The coordinates are needed to inform the display frame buffer to replace the appropriate pixel at its end based on this X, Y coordinate. The drawback of the pixel-based approach may be illustrated by examining the amount of data required for transmission of a certain amount of data:

# of bytes per Pixel in FB=4 bytes (3 bytes for RGB+1 for Alpha)

# of bytes for representing X+Y=4 bytes (supports up to 65536×65536)

Total # bytes per pixel (NP)=8 bytes of data+control data

Bytes to be transmitted per 100 pixels=800 bytes

This may be compared to a tile-based granularity for tile dimensions of, for example, 10×10 pixels. In this scenario, the X, Y coordinate for the tile is sent, followed by the pixel data. There is no need to send per pixel coordinates as the tile coordinates are sufficient to identify the pixels being received on the display end. A description of a tile may be as, for example, shown for a damage rectangle in FIG. 7. The savings are highlighted below:

# of bytes per Pixel in FB=4 bytes (3 bytes for RGB+1 for Alpha)

# of bytes for representing X+Y=4 bytes (supports up to 65536×65536 pixels)

Total # bytes per Tile (NT)=N*4 bytes of data+(X,Y)+control data

Bytes to be transmitted per 100 pixel=400+4 bytes=404 bytes~=50% reduction in data Thus, the tile (or macroblock) granularity makes sending updates as a tile a better granularity than pixels for certain types of screen updates. Control data represents the protocol related headers/markers that need to be sent for proper transmission of display contents, and the size of control data depends on the display protocol that will be used for transferring the contents to the display.

Another factor to consider is the type of data storage on a frame buffer. In some hardware, there is specific support for fetching tiles from memory, and thus data is stored in tile order rather than pixel order in the frame buffer on such architecture. If a tile-order frame buffer is utilized, then accessing adjacent data from a tile is much faster than accessing individual pixels from different indexes in the frame buffer. In some embodiments, by including all these parameters described above, an apparatus or system may select an appropriate granularity of the data transmission dynamically.

In some embodiments, in order to select a data transfer granularity, the type of frame buffer data storage is first obtained, and together with this information the display control data for pixel/tile is estimated at the time of initialization of the frame buffer. Damage information is obtained from the SPU hardware or software mechanism to identify the location of the pixels in the frame buffer per frame. In some embodiments, the following computation is performed:

(1) Calculate number of bytes to be transmitted+control for Pixels (NP)

(2) Calculate Number of bytes to be transmitted+control for Tiles (NT)

(3) Calculate Number of bytes to be transmitted+control for Scanlines (NS)

An embodiment of a process for selecting a granularity based on these calculations may be as follows:

If (NP<=NT)&&(NP<=NS) then

Fetch Pixels from FB; Transmit data+Control to panel at VBlank arrival Else if (NT<=NS)

Fetch Tiles from FB; Transmit data+Control to panel at VBlank arrival Else

Fetch Scanlines from FB; Transmit data+control to panel at VBlank arrival

Figure 3:
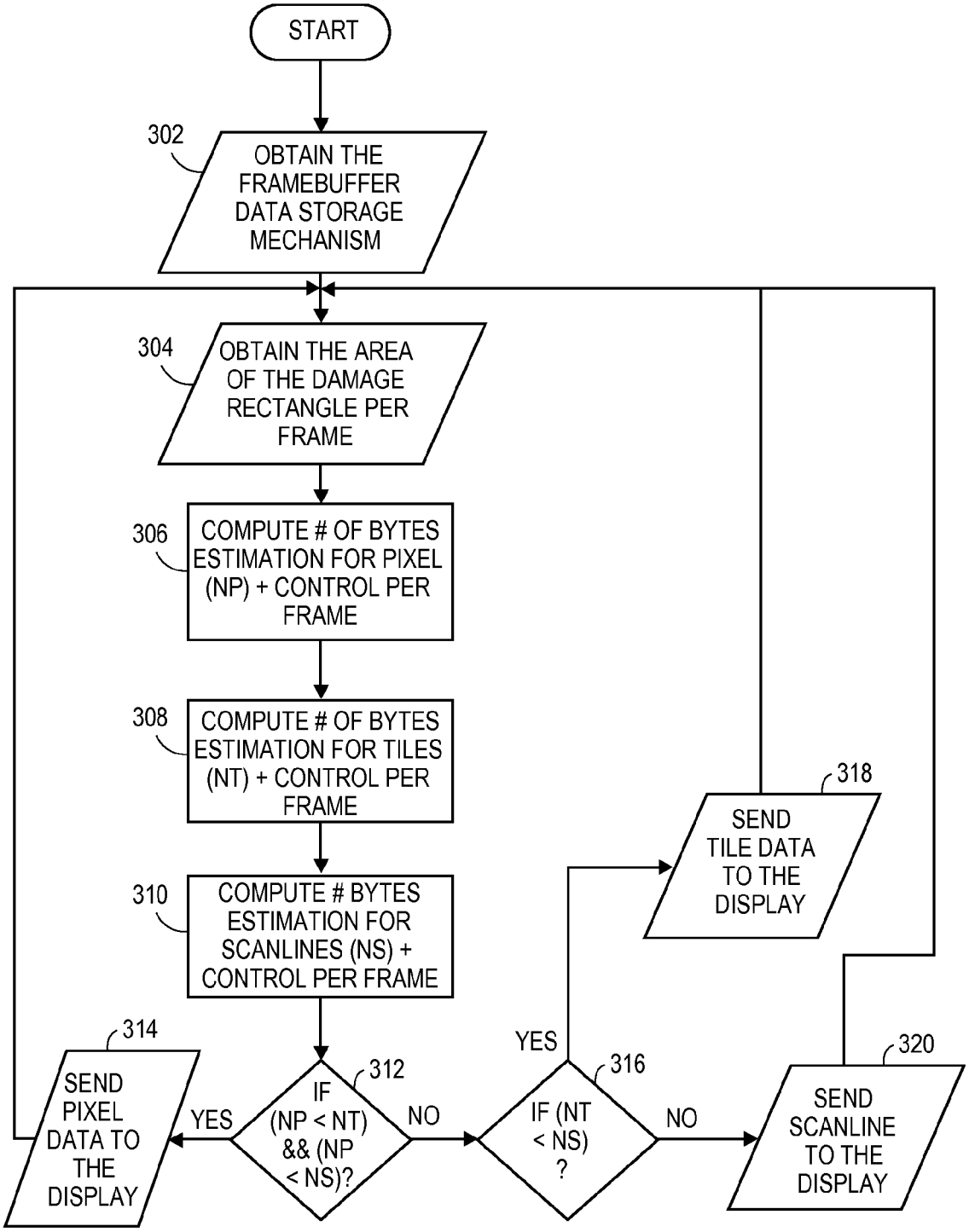
FIG. 3 is a flowchart to illustrate an embodiment of an estimation method for partial update of a display.

FIG. 3 is a flowchart to illustrate an embodiment of an estimation method for partial update of a display. The actual implementation of an estimation mechanism can be platform dependent as the amount of power consumption can vary depending on the platform being used. In some embodiments, for a specific platform, if the damage exceeds a certain number of pixels, then tiles (macroblocks) may be used, and otherwise pixels may be sent to the panel. In some embodiments, if the damage matches certain geometric proportions spanning the entire width of the panel, then scanlines may be used.

In some embodiments, a process is provided to dynamically switch between units of different granularities that can be sent to the display depending on screen update. As illustrated in the embodiment shown in FIG. 3 for a particular image damage, a frame buffer data storage mechanism is obtained 302. The area of the damage rectangle per frame is obtained 304. In some embodiments, calculations are made for the following for the damage rectangle: The number of bytes to be transmitted plus control data per frame for pixel granularity (NP) 306; the number of bytes to be transmitted plus control data per frame for tile granularity (NT) 308; and the number of bytes to be transmitted plus control data for scanline granularity (NS) 310.

In some embodiments, if NP is less than NT and NP is less than NS 312 (indicating that the amount of data to transmitted for pixel granularity is less than either tile granularity or scanline granularity), then pixel data is sent to the display 314, and the process returns to obtaining the area of the next damage rectangle 304. In some embodiments, if NT is less than NS 316 (indicating that the amount of data to be transmitted for tile granularity is less than scanline granularity), then tile data is sent to the display 318, and the process returns to obtaining the area of the next damage rectangle 304. If not, then scanline data is sent to the display 320, and the process continues with the area of the next damage rectangle 304.

While the process illustrated in FIG. 3 regards pixel, tile, and scanline granularity, embodiments of a process are not limited to these particular values, and may include calculations and comparisons for other granularities.

Figure 4A:
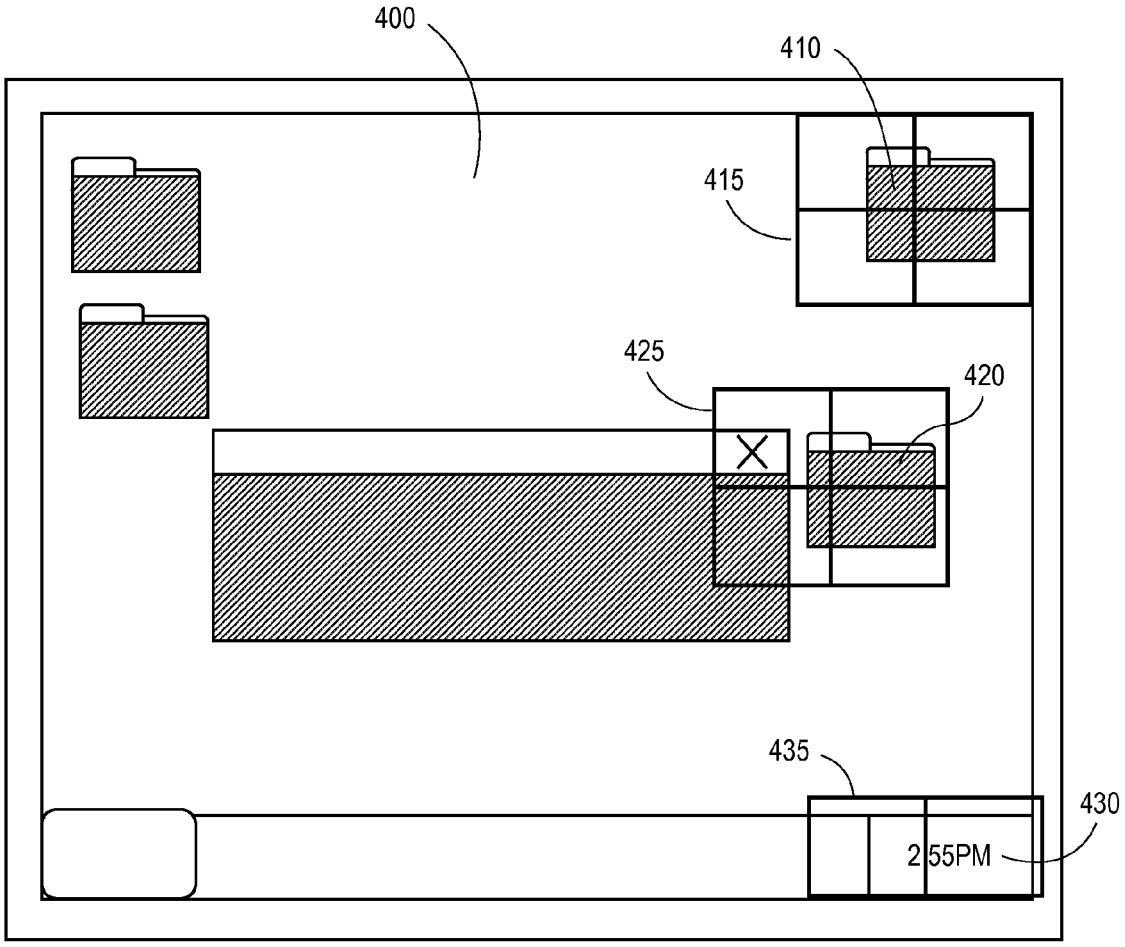
FIGS. 4A and 4B illustrate embodiments of screen update consolidation for partial update of a display.
Figure 4B:
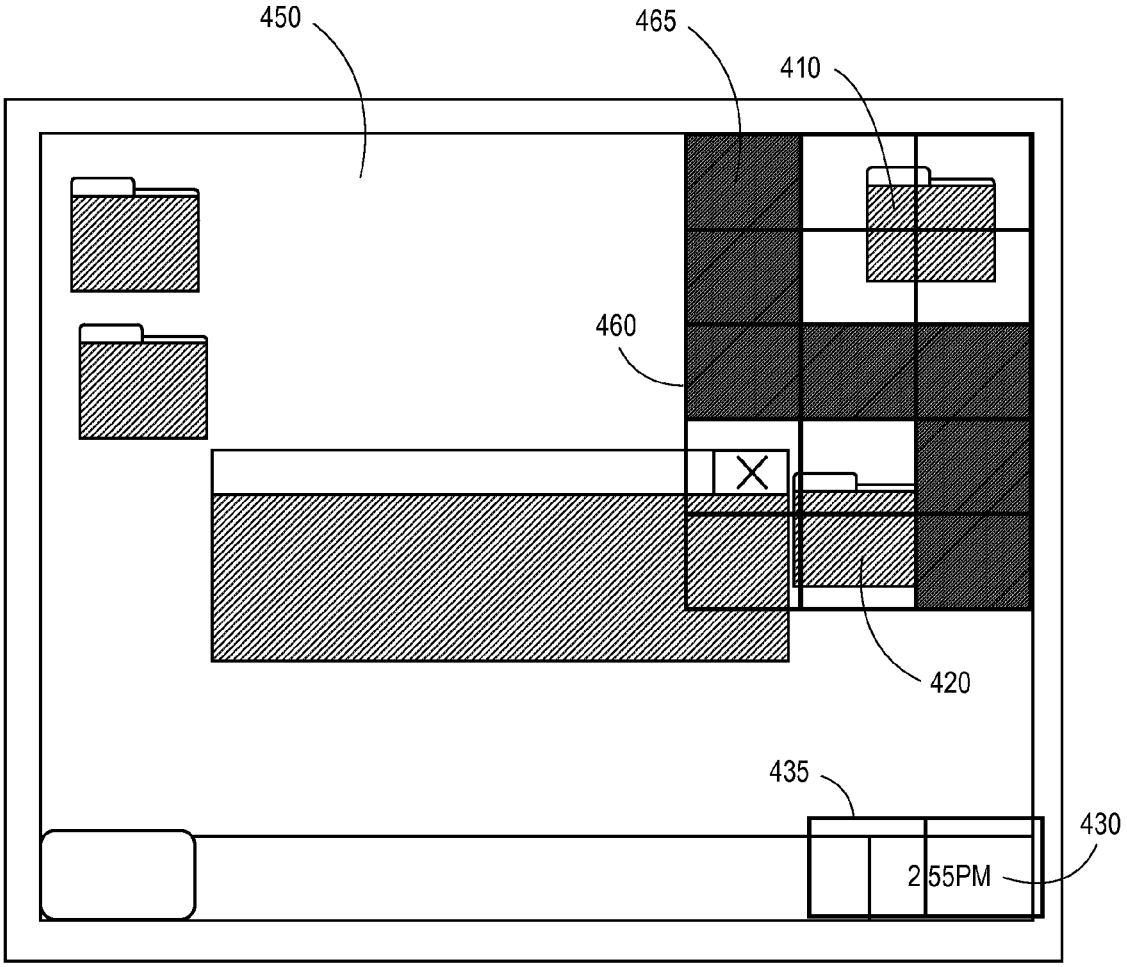

In some embodiments, an additional dimension to optimizing the amount of traffic updates that will be sent is management of the screen update (damage region) upon the frame. FIGS. 4A and 4B illustrate embodiments of screen update consolidation for partial update of a display. FIG. 4A illustrates a scenario whereby damage area that is spread across a screen is consolidated into a unit, such as one rectangle. In this manner, frame buffer memory fetch operations and control data are simplified, thereby improving performance of the sub-system. In some embodiments, a technique for screen data consolidation can be used in conjunction with dynamic switching of data granularity as different area are handled differently.

In this illustration, multiple areas include screen updates, including within a screen 400 a first damage area 410 and a second damage area 420, where the first and second damage areas are updated or new file icons, together with a third damage area 430, where the third damage area is an updated clock. As illustrated, the first damage area 410 may be transmitted in a first set of tiles 415, the second damage area 420 may be transmitted in a second set of tiles 425, and the third damage area 430 may be transmitted in a third set of tiles 435. In some embodiments, the damage areas may be handled separately in varying manners using units of different granularities. For example, the first damage area 410 and the second damage area 420 may be transmitted using tile granularity, while the third damage area 430, which is a small area of the image, may be transmitted using pixel granularity.

In some embodiments, two or more of a plurality of damage areas of an image may be consolidated, such as consolidation into a larger grouping of tiles as a consolidated damage group if the such combination results in a reduced amount of data. In FIG. 4B, the image 450 includes a consolidated damage group 460 that includes the first set of times 415 and the second set of tiles 425 together with additional intervening tiles 465 to generate the consolidated damage group 460. In some embodiments, consolidated damage areas can be tile-based updates while the clock in the third damage area 430 may be sent using pixel-based mechanism.

In some embodiments, a decision to consolidate damage areas across a screen is a function of memory operations required to fetch the frame buffer data along with the number of control bytes that will be sent for the pixels/tiles and the additional consolidated damage region. In some embodiments, a calculation may be provided as:

Screen Damage data=$Fn$(ΣDamage area+Control data, # of damage area memory operations bounding box area of polygon+control data, # of damage area memory operations for bounding box)

In some embodiments, if the damage area cost of transmission of data exceeds a certain threshold, the bounding box data is transmitted to the panel, thereby improving memory operations while not transmitting a large amount of redundant data.

In some embodiments, the amount of consolidation performed per screen is platform dependent. This is due to the fact that the cost of memory operations to fetch the frame buffer contents could differ widely depending on the memory and cache hierarchy, the size of the frame buffer, the display link speed, and the size of buffer on the display controller. For example, a first platform may be implemented to consolidate damage areas of an image only if the damage area exceeds a certain amount of contiguous locations while a second platform may consolidate areas more aggressively as the memory and display controller frame buffer fetches are optimized for adjacent cache lines. The choice of where or not to consolidate may include additional elements in other embodiments.

In some embodiments, an apparatus or system includes the following hardware elements: (1) a video display having its own full frame buffer and having the ability to retain images when no screen updates are sent; (2) a hardware controller that support a feature for sending a partial frame buffer to the video display.

Figure 5:
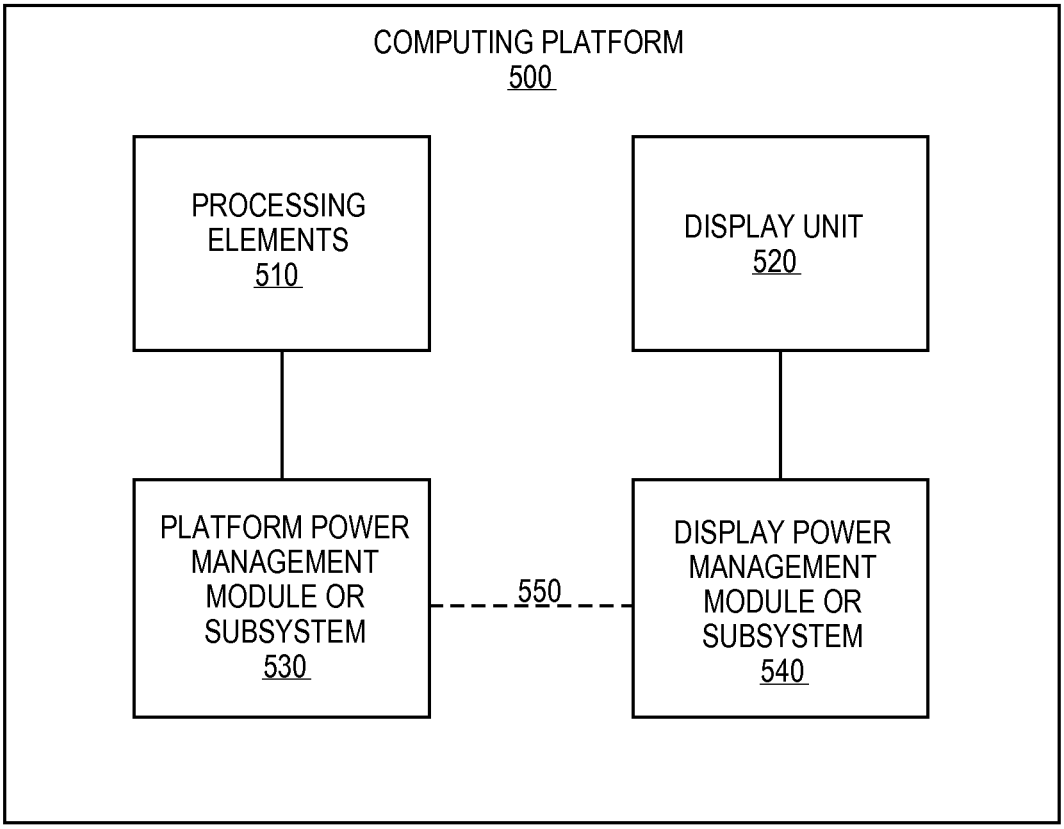
FIG. 5 is an illustration of an embodiment of a power management system for a computer platform.

FIG. 5 is an illustration of an embodiment of a power management system for a computer platform. In some embodiments, a high level view of a computing platform 500 includes processing elements 510 and a display unit 520, among other elements that are not illustrated here. The computing platform 500 may be a mobile device operating on battery or other limited mobile power source. In some embodiments, the computing platform 510 includes systems for power management of the platform 510, including a platform power management unit module or subsystem 530 and a display power management module or subsystem 540 (where the modules or subsystems may include multiple components or functions of components). In some embodiments, the display power management module 540 may include functionality to provide display updates only when there are image changes (screen damage), the display power management module providing for dynamic selection of the granularity of units used to transfer screen damage data in order to reduce or minimize data transfer. In some embodiments, the display power management module further provides for consolidating two or more damage areas to further reduce total data transferred.

In some embodiments, the computing platform 500 provides for coordination 550 between the platform power management unit module 530 and a display power management module 540. In some embodiments, the computing platform 500 utilizes data for display power management to allow the computing platform to transition to or remain in a lower power active state (IIM) when display updates are not required.

Figure 6:
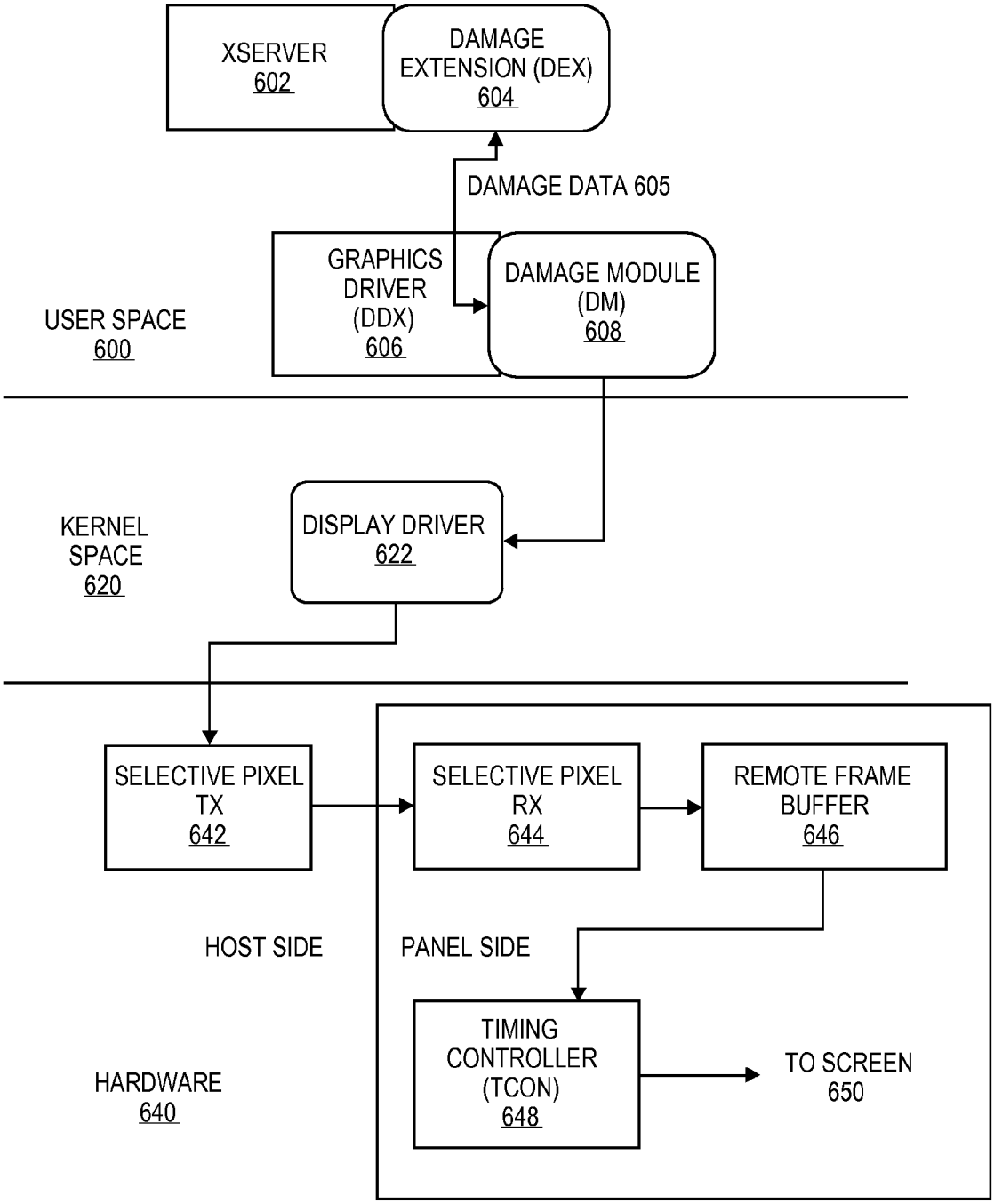
FIG. 6 is an illustration of an embodiment of a system for partial frame update.

FIG. 6 is an illustration of an embodiment of a system for display partial update. In some embodiments, the display partial update includes dynamic selection of the granularity used to transfer screen damage data in order to reduce or minimize data transfer. In some embodiments, the display partial update further provides for consolidating two or more damage areas to further reduce total data transferred.

In this illustration, a system includes a user space 600 and a kernel space 620, together with certain hardware 640. In some embodiments, the user space includes an X server 602 with damage extension (DEx) 604 to generate damage data 605 reflecting changes to a screen image, the damage extension providing at least part of a damage detection element for the system. In some embodiments, the user space further includes a graphics driver (DDX) 606 and a damage module (DM) 608 to receive the damage data, where the damage module 608 initializes the SPU setup, and further performs a handshake with DEx 604 for receiving the screen damage notifications. In some embodiments, DEx 604 sends the pixel damage to the damage module 608 when there are 2-D changes on the root window (entire screen) in the form of Cartesian coordinates. In some embodiments, the damage module 608 checks for the validity of the data, and accumulates the damage for a time period of one frame (typical ~16.66 ms). In some embodiments, the damage may be transmitted in units of one of plurality of different granularities. In some embodiments, multiple areas of damage may be consolidated for transmission.

In some embodiments, at the expiry of a frame time, pixel damage data is sent to a display driver 622 (illustrated in the kernel space 620) via an IOCTL (input/output control) interface. In some embodiments, the display driver 622 is responsible for configuring the display panel and a selective pixel transmitter (SPTx) 642 at startup, and for synchronizing the pixel data transfer.

In some embodiments, upon receiving a Vblank interrupt, the display driver 622 checks for pixel updates to a frame buffer, and, if present, then the display driver 622 configures the selective pixel transmitter 642 to transmit the damage area pixels to the panel side logic, where the damage area pixels are transmitted in units of a chosen granularity. In some embodiments, this operation completes the display activity on the host side, and it is the responsibility of the panel side logic to ensure the pixels are shown correctly. In some embodiments, if there is no update to the local frame buffer (no damage), then the selective pixel transmitter 642 is power-gated by the display driver 622 to low power mode until any new data needs to be sent to the remote frame buffer. In some embodiments, dynamic selection of the granularity used to transfer screen damage data in order to reduce or minimize data transfer. In some embodiments, the display power management module further provides for consolidating two or more damage areas to further reduce total data transferred.

In some embodiments, a panel side logic module referred to as the selective pixel receiver (SPRx) 644 receives the pixels provided by the selective pixel transmitter 642 and updates a remote frame buffer 646 with the new data. In some embodiments, a timing controller (TCON) 648 operates to scan the remote frame buffer at the start of each new frame, with the pixel then provided to the screen 650 for display. In some embodiments, as the timing controller 648 will always refresh its contents from the remote frame buffer 646, the SPU technique provides a stable image even when there is no data sent to remote frame buffer 646. In some embodiments, the display activity will persist until the platform operates to remove the power from the display due to long inactivity (such as, a screensaver event).

FIG. 7 is an illustration of a screen damage rectangle used in an embodiment of display partial update. In some embodiments, a damage rectangle 700 may be defined by a point (X1, Y1) and the width and height of the damage rectangle. As illustrated, the damage rectangle includes four corner points defined by such data, the corner points being (X1, Y1), (X1+Width, Y1), (X1, Y1+Height), and (X1+Width, Y1+Height).

Figure 8:
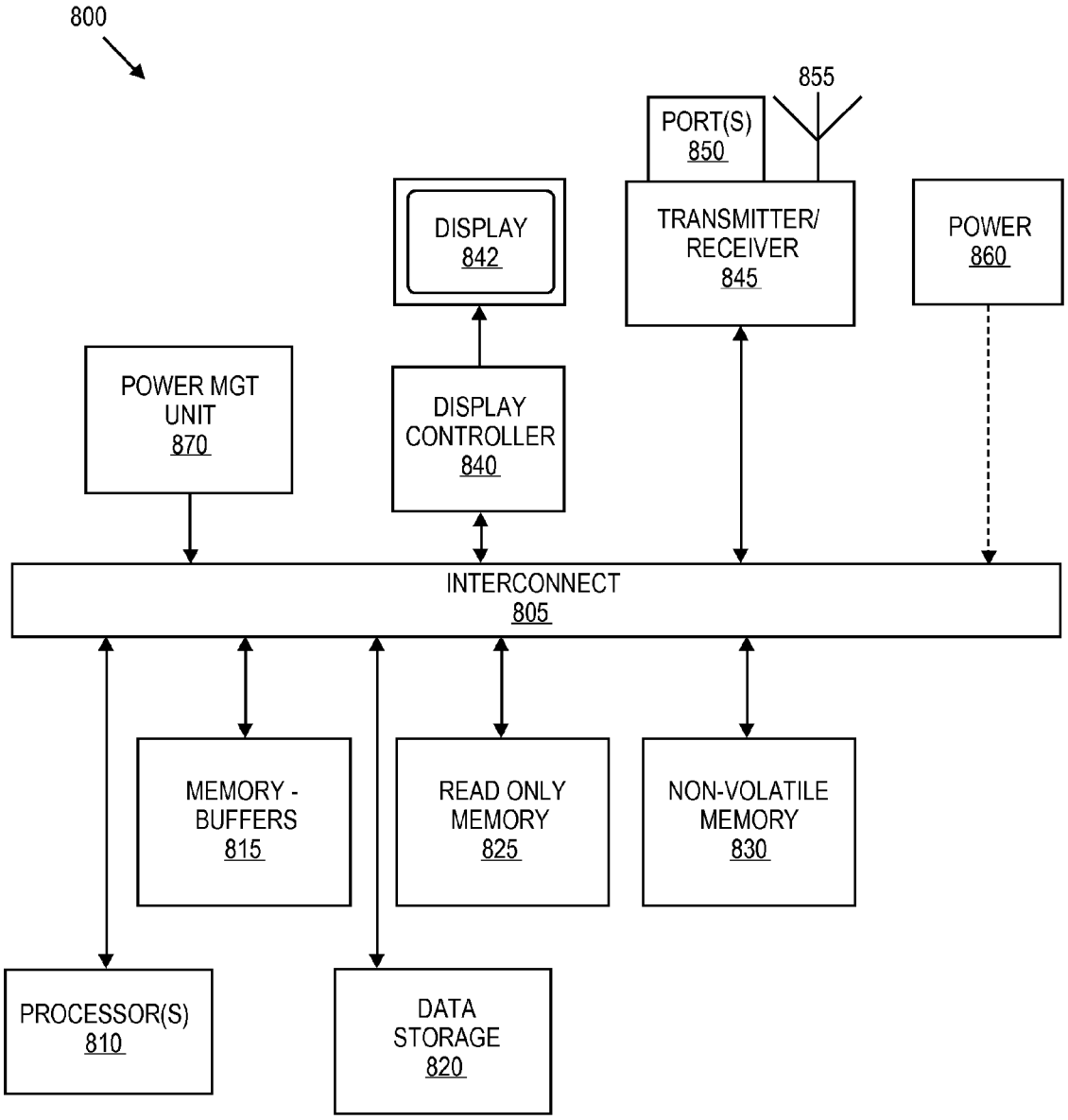
FIG. 8 illustrates an embodiment of a mobile device or other computing platform.

FIG. 8 illustrates an embodiment of a mobile device or other computing platform. In some embodiments, a mobile device or other computing platform (referred to herein generally as a device) 800 includes dynamic selection of the granularity used to transfer screen damage data in order to reduce or minimize data transfer. In some embodiments, the device 800 further provides for consolidating two or more damage areas to further reduce total data transferred.

In this illustration, certain standard and well-known components that are not germane to the present description are not shown. In some embodiments, the device includes a display controller 840 coupled with a display 842. In some embodiments, the display controller 840 dynamically selects which of a plurality of granularities is to be used in the transmission of pixel data to the display 842, where the plurality of granularities may include pixel data, tiles, and scanlines. In some embodiments, the display controller 840 chooses whether to consolidate two or more damage areas for transmission to the display 842. In some embodiments, the display 842 may include a liquid crystal display (LCD) or any other display technology, for displaying information or content to a user. In some environments, the display 842 may include a touch-screen that is also utilized as at least a part of an input device. In some environments, the display 842 may include an audio device, such as a speaker for providing audio information.

In some embodiments, the device 800 may further include a power management unit 870 for the management of power in the device. In some embodiments, the device operates to coordinate platform power control with display power control to allow for transition of the device to a lower power state when the display controller 840 is not actively providing updates to the display 842.

In addition:

Under some embodiments, the device 800 comprises an interconnect or crossbar 805 or other communication means for transmission of data. The device 800 may include a processing means such as one or more processors 810 coupled with the interconnect 805 for processing information. The processors 810 may comprise one or more physical processors and one or more logical processors. The processors 810 may be a part of a system on chip (SoC), including, for example, an implementation in which the SoC is a part of a mobile device. The interconnect 805 is illustrated as a single interconnect for simplicity, but may represent multiple different interconnects or buses and the component connections to such interconnects may vary. The interconnect 805 shown in FIG. 8 is an abstraction that represents any one or more separate physical buses, point-to-point connections, or both connected by appropriate bridges, adapters, or controllers.

In some embodiments, the device 800 further comprises a random access memory (RAM) or other dynamic storage device or element as a main memory and other memory (including memory buffers) 815 for storing information and instructions to be executed by the processors 810. The memory 815 may include one or more frame buffers for the storage of video data. Memory 815 also may be used for storing data for data streams or sub-streams. RAM memory includes dynamic random access memory (DRAM), which requires refreshing of memory contents, and static random access memory (SRAM), which does not require refreshing contents, but at increased cost. DRAM memory may include synchronous dynamic random access memory (SDRAM), which includes a clock signal to control signals, and extended data-out dynamic random access memory (EDO DRAM). The device 800 also may comprise a read only memory (ROM) 825 or other static storage device for storing static information and instructions for the processors 810. The device 800 may include one or more non-volatile memory elements 830, including, for example, flash memory, for the storage of certain elements.

Data storage 820 may also be coupled to the interconnect 805 of the device 800 for storing information and instructions. The data storage 820 may include a magnetic disk, an optical disc and its corresponding drive, or other memory device. Such elements may be combined together or may be separate components, and utilize parts of other elements of the device 800.

One or more transmitters or receivers 845 may also be coupled to the interconnect 805. In some embodiments, the device 800 may include one or more ports 850 for the reception or transmission of data. The device 800 may further include one or more antennas 855 for the transmission and reception of data via radio signals.

The device 800 may also comprise a power device or system 860, which may comprise a power supply, a battery, a solar cell, a fuel cell, or other system or device for providing or generating power. The power provided by the power device or system 860 may be distributed as required to elements of the device 800. In some embodiments, the power management unit 870 operates to control consumption of power from the power device or system 860 through the coordination of platform power management with display power management.

In the description above, for the purposes of explanation, numerous specific details are set forth in order to provide a thorough understanding of the described embodiments. It will be apparent, however, to one skilled in the art that embodiments may be practiced without some of these specific details. In other instances, well-known structures and devices are shown in block diagram form. There may be intermediate structure between illustrated components. The components described or illustrated herein may have additional inputs or outputs which are not illustrated or described.

Various embodiments may include various processes. These processes may be performed by hardware components or may be embodied in computer program or machine-executable instructions, which may be used to cause a general-purpose or special-purpose processor or logic circuits programmed with the instructions to perform the processes. Alternatively, the processes may be performed by a combination of hardware and software.

Portions of various embodiments may be provided as a computer program product, which may include a computer-readable medium having stored thereon computer program instructions, which may be used to program a computer (or other electronic devices) for execution by one or more processors to perform a process according to certain embodiments. The computer-readable medium may include, but is not limited to, magnetic disks, optical disks, compact disk read-only memory (CD-ROM), and magneto-optical disks, read-only memory (ROM), random access memory (RAM), erasable programmable read-only memory (EPROM), electrically-erasable programmable read-only memory (EEPROM), magnet or optical cards, flash memory, or other type of computer-readable medium suitable for storing electronic instructions. Moreover, embodiments may also be downloaded as a computer program product, wherein the program may be transferred from a remote computer to a requesting computer.

Many of the methods are described in their most basic form, but processes can be added to or deleted from any of the methods and information can be added or subtracted from any of the described messages without departing from the basic scope of the present invention. It will be apparent to those skilled in the art that many further modifications and adaptations can be made. The particular embodiments are not provided to limit the invention but to illustrate it. The scope of the embodiments of the present invention is not to be determined by the specific examples provided above but only by the claims below.

If it is said that an element "A" is coupled to or with element "B," element A may be directly coupled to element B or be indirectly coupled through, for example, element C. When the specification or claims state that a component, feature, structure, process, or characteristic A "causes" a component, feature, structure, process, or characteristic B, it means that "A" is at least a partial cause of "B" but that there may also be at least one other component, feature, structure, process, or characteristic that assists in causing "B." If the specification indicates that a component, feature, structure, process, or characteristic "may", "might", or "could" be included, that particular component, feature, structure, process, or characteristic is not required to be included. If the specification or claim refers to "a" or "an" element, this does not mean there is only one of the described elements.

An embodiment is an implementation or example of the present invention. Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. It should be appreciated that in the foregoing description of exemplary embodiments of the present invention, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims are hereby expressly incorporated into this description, with each claim standing on its own as a separate embodiment of this invention.

The following examples pertain to further embodiments:

In some embodiments, an apparatus includes a display controller to transfer pixel data from a frame buffer to a video display and to select a granularity of a plurality of granularities for units of data for the transfer of the pixel data; and a detection element to track updates to the frame buffer, the detection element to identify at least a first damage area of the pixel data that has been changed from a previous image, wherein the display controller is to provide the video display with the identified first damage area of the pixel data in one more or more units of data of the chosen granularity.

In some embodiments, the plurality of granularities includes pixel data, scanline data, and tile data.

In some embodiments, the selection of the granularity is based at least in part on a size of the first damage area.

In some embodiments, the selection of the granularity includes a comparison of a total amount of data required for transmission of the pixel data that has been changed, wherein the total amount of data includes pixel data and control data for the one or more units of data.

In some embodiments, the selection of the granularity includes selecting a first granularity for the first damage area and a second granularity for a second damage area.

In some embodiments, the display controller is to determine whether to consolidate two or more damage areas of pixel data that have been changed from the previous image for transfer of the pixel data. In some embodiments, wherein the determination whether to consolidate the two or more damage areas of pixel data is based at least in part on whether the consolidation will reduce a total amount of data required for transmission of the pixel data.

In some embodiments, the display controller is to provide partial update data to the video display without providing at least one area of the pixel data that has not been changed from the previous image.

In some embodiments, the apparatus further includes a power management unit to provide power management for the apparatus, wherein the power management unit is to determine whether to transition the apparatus into a reduced power state based at least in part on whether the display controller has pending video data for the video display.

In some embodiments, a method includes obtaining pixel data for an image for a display; identifying one or more areas of pixel data including a first area that have been changed from a previous image; selecting a first granularity of a plurality of granularities for units of data for the transfer of the pixel data of the first area; and transferring one or more units of data of the first granularity to a display.

In some embodiments, the plurality of granularities includes data based on pixels, data based on lines of an image, and data based on damage rectangles of an image.

In some embodiments, selecting the first granularity includes a comparison of a total amount of data required for transmission of the pixel data of the first area, wherein the total amount of data includes pixel data and control data for the one or more units of data.

In some embodiments, the method further includes selecting a second granularity for a second area of the one or more areas of pixel data that have been changed. In some embodiments, the first granularity and the second granularity are different.

In some embodiments, the method further includes determining whether to consolidate two or more of the areas of pixel data that have been changed for transfer of the pixel data. In some embodiments, determining whether to consolidate the two or more areas of pixel data includes determining whether the consolidation will reduce a total amount of data required for transmission of the pixel data of the two or more areas.

In some embodiments, a computer system includes a display; a frame buffer; a display controller to transfer pixel data from the frame buffer to the display; and a detection element to track updates to the frame buffer, the detection element to identify one or more damage areas of the pixel data that have been changed from a previous image, the one more damage areas including a first damage area. In some embodiments, the display controller is to select a first granularity of a plurality of granularities for one or more units of data for the transfer of pixel data of the first damage area, and is to provide the display with the identified one or more damage areas, including provision of the first damage area of the pixel data in one more or more units of data of the chosen granularity.

In some embodiments, the first granularity is one of data based on pixels of an image, data based on lines of the image, or data based on damage rectangles of the image.

In some embodiments, the selection of the first granularity includes a comparison of data required for transmission of the pixel data that has been changed, including pixel data and control data for the one or more units of data.

In some embodiments, the display controller is further to consolidate two or more damage areas of pixel data that have been changed from the previous image for transfer of the pixel data. In some embodiments, a determination whether to consolidate the two or more damage areas of pixel data is based at least in part on whether the consolidation will reduce a total amount of data required for transmission of the pixel data.

In some embodiments, the display of the system is a touch screen display.

In some embodiments, a computer-readable storage medium having stored thereon data representing sequences of instructions that, when executed by a processor, cause the processor to perform operations including: obtaining pixel data for an image for a video display; identifying one or more areas of pixel data including a first area that have been changed from a previous image; selecting a first granularity of a plurality of granularities for units of data for the transfer of the pixel data of the first area; and transferring one or more units of data of the first granularity to a display.

In some embodiments, the plurality of granularities includes pixel data, scanline data, and tile data.

In some embodiments, selecting the first granularity includes a comparison of a total amount of data required for transmission of the pixel data of the first area.

In some embodiments, the medium includes instructions for determining whether to consolidate two or more of the areas of pixel data that have been changed for transfer of the pixel data. In some embodiments, determining whether to consolidate the two or more areas of pixel data includes determining whether the consolidation will reduce a total amount of data required for transmission of the pixel data of the two or more areas.

In some embodiments, a machine-readable storage includes machine-readable instructions, when executed, to implement any of the aforementioned methods.

In some embodiments, an apparatus includes means for obtaining pixel data for an image for a video display; means for identifying one or more areas of pixel data including a first area that have been changed from a previous image; means for selecting a first granularity of a plurality of granularities for units of data for the transfer of the pixel data of the first area; and means for transferring one or more units of data of the first granularity to a display.

In some embodiments, the plurality of granularities includes pixel data, scanline data, and tile data.

In some embodiments, wherein selecting the first granularity includes a comparison of a total amount of data required for transmission of the pixel data of the first area.

In some embodiments, the apparatus further includes means for determining whether to consolidate two or more of the areas of pixel data that have been changed for transfer of the pixel data. In some embodiments, the means for determining whether to consolidate the two or more areas of pixel data includes means for determining whether the consolidation will reduce a total amount of data required for transmission of the pixel data of the two or more areas.

What is claimed is:

1. An apparatus comprising:

a display controller to transfer pixel data from a frame buffer to a video display and to select a granularity of a plurality of granularities for units of data for the transfer of the pixel data, wherein each of the plurality of preconfigured granularities includes a certain portion of an image; and a detection element to track updates to the frame buffer, the detection element to identify at least a first damage area of the pixel data that has been changed from a previous image;

wherein the selection of the granularity includes a comparison of a total amount of data required for each of the plurality of preconfigured granularities for transmission of the pixel data that has been changed, the total required amount of data including pixel data and control data required for each of the plurality of preconfigured granularities, and wherein the selection of granularity includes selecting a granularity with a smallest total required amount of data; and wherein the display controller is to provide the video display with the identified first damage area of the pixel data in one or more units of data of the selected granularity.

2. The apparatus of claim 1, wherein the plurality of preconfigured granularities includes pixel data, scanline data, and tile data.

3. The apparatus of claim 1, wherein the selection of the granularity is further based at least in part on a size of the first damage area.

4. The apparatus of claim 1, wherein the selection of the granularity includes selecting a first granularity for the first damage area and a second granularity for a second damage area.

5. The apparatus of claim 1, wherein the display controller is further to determine whether to consolidate two or more damage areas of pixel data that have been changed from the previous image for transfer of the pixel data.

6. The apparatus of claim 5, wherein the determination by the display controller whether to consolidate the two or more damage areas of pixel data is based at least in part on whether the consolidation will reduce a total amount of data required for transmission of the pixel data.

7. The apparatus of claim 1, wherein the display controller is to provide partial update data to the video display without providing at least one area of the pixel data that has not been changed from the previous image.

8. The apparatus of claim 1, further comprising a power management system, including a platform power management subsystem and display power management subsystem, to provide power management for the apparatus, wherein the power management system is to determine whether to transition the apparatus into a reduced power state based at least in part on whether the display controller has pending video data for the video display.

9. A method comprising:

obtaining pixel data for an image for a display;

identifying one or more areas of pixel data including a first area that have been changed from a previous image;

selecting a first granularity of a plurality of preconfigured granularities for units of data for the transfer of the pixel data of the first area, wherein each of the plurality of preconfigured granularities includes a certain portion of an image; and transferring one or more units of data of the first granularity to the display;

wherein selecting the first granularity includes a comparison of a total amount of data required for each of the plurality of preconfigured granularities for transmission of the pixel data that has been changed, the total required amount of data including pixel data and control data for each of the plurality of preconfigured granularities, and wherein selecting the first granularity includes selecting a granularity with a smallest total required amount of data.

10. The method of claim 9, wherein the plurality of preconfigured granularities includes data based on pixels, data based on lines of an image, and data based on damage rectangles of an image.

11. The method of claim 9, further comprising selecting a second granularity for a second area of the one or more areas of pixel data that have been changed.

12. The method of claim 11, wherein the first granularity and the second granularity are different.

13. The method of claim 9, further comprising determining whether to consolidate two or more of the areas of pixel data that have been changed for transfer of the pixel data.

14. The method of claim 13, wherein determining whether to consolidate the two or more areas of pixel data includes determining whether the consolidation will reduce a total amount of data required for transmission of the pixel data of the two or more areas.

15. A computer system comprising:

a display;

a frame buffer;

a display controller to transfer pixel data from the frame buffer to the display; and a detection element to track updates to the frame buffer, the detection element to identify one or more damage areas of the pixel data that have been changed from a previous image, the one more damage areas including a first damage area;

wherein the display controller is to select a first granularity of a plurality of preconfigured granularities for one or more units of data for the transfer of pixel data of the first damage area, wherein each of the plurality of preconfigured granularities includes a certain portion of an image;

wherein the selection of the granularity includes a comparison of a total amount of data required for each of the plurality of preconfigured granularities for transmission of the pixel data that has been changed, the total required amount of data including pixel data and control data required for each of the plurality of preconfigured granularities, and wherein the selection of granularity includes selecting a granularity with a smallest total required amount of data; and wherein the display controller is to provide the display with the identified one or more damage areas, including provision of the first damage area of the pixel data in one or more units of data of the selected granularity.

16. The system of claim 15, wherein the first granularity is one of data based on pixels of an image, data based on lines of the image, or data based on damage rectangles of the image.

17. The system of claim 15, wherein the display controller is further to consolidate two or more damage areas of pixel data that have been changed from the previous image for transfer of the pixel data, wherein a determination whether to consolidate the two or more damage areas of pixel data is based at least in part on whether the consolidation will reduce a total amount of data required for transmission of the pixel data.

18. The system of claim 15, wherein the display is a touch screen display.

19. A non-transitory computer-readable storage medium having stored thereon data representing sequences of instructions that, when executed by a processor, cause the processor to perform operations comprising:

obtaining pixel data for an image for a video display;

identifying one or more areas of pixel data including a first area that have been changed from a previous image;

selecting a first granularity of a plurality of preconfigured granularities for units of data for the transfer of the pixel data of the first area, wherein each of the plurality of preconfigured granularities includes a certain portion of an image; and transferring one or more units of data of the first granularity to the video display;

wherein selecting the first granularity includes a comparison of a total amount of data required for each of the plurality of preconfigured granularities for transmission of the pixel data that has been changed, the total required amount of data including pixel data and control data required for each of the plurality of preconfigured granularities, and wherein selecting the first granularity includes selecting a granularity with a smallest total required amount of data.

20. The medium of claim 19, wherein the plurality of preconfigured granularities includes pixel data, scanline data, and tile data.

21. The medium of claim 19, further comprising instructions that, when executed by the processor, cause the processor to perform operations comprising:

determining whether to consolidate two or more of the areas of pixel data that have been changed for transfer of the pixel data, wherein determining whether to consolidate the two or more areas of pixel data includes determining whether the consolidation will reduce a total amount of data required for transmission of the pixel data of the two or more areas.

* * * * *